United States Patent [19]

Clarke, Jr. et al.

[11] Patent Number: 4,492,065

[45] Date of Patent: Jan. 8, 1985

[54] SELF-ARCING TANK SEGMENTS

[76] Inventors: Herbert H. Clarke, Jr., 800 Garden St., Santa Barbara, Calif. 93101; William E. Reefman, 2420 Calle Soria, Santa Barbara, Calif. 93109

[21] Appl. No.: 3,418

[22] Filed: Jan. 15, 1979

[51] Int. Cl.[3] ..... E04B 2/08; E04H 12/16

[52] U.S. Cl. ..... 52/595; 52/224; 52/248

[58] Field of Search ..... 52/245, 246, 224, 248, 52/595, 594; 220/5 R; 46/30

[56] References Cited

U.S. PATENT DOCUMENTS

| | | | |
|---|---|---|---|
| 1,358,203 | 11/1920 | Herrmann | 220/76 |
| 3,291,437 | 12/1966 | Bowden | 220/5 R |
| 3,835,602 | 9/1974 | Tuuri | 52/245 |
| 3,951,294 | 4/1976 | Wilson | 52/245 |
| 3,974,605 | 8/1976 | Beatty | 52/594 |

FOREIGN PATENT DOCUMENTS

| | | | |
|---|---|---|---|
| 1902718 | 8/1970 | Fed. Rep. of Germany | 52/245 |

*Primary Examiner*—John E. Murtagh

[57] ABSTRACT

Vertical boards or tank segments are compressed by outer horizontal bands that cause the vertical edges of these tank segments to press together. Each tank segment has a web and edge structures that are thicker than the web measured in a radial direction in the finished tank. The compression of the horizontal bands causes these edge sections to exert a bending movement on the web, bending the web outwardly until it contacts the outer horizontal bands. One size of tank segment, therefore, serves for a large number of different diameters of cylindrical tank. The webs are formed flat, and the thickened edges are preferably tongue-and-groove configuration.

3 Claims, 7 Drawing Figures

SELF-ARCING TANK SEGMENTS

This invention relates to the construction of cylindrical tanks having vertical sections and has particular reference to a construction of an elongated board or a plank or a tank segment that is normally flat, but automatically assumes the curvature radius of the tank during construction before the tank is filled with liquid.

BACKGROUND OF THE INVENTION

Tanks for holding liquids such as water and oil have traditionally been formed of vertical wooden boards pulled into a cylindrical shape by horizontal outside tension bands. The bands have been tightened to the point of crushing the adjoining edges to prevent leakage.

The usual wooden vertical tank board has a horizontal width that is two or at most three times the thickness of the board to avoid vertical cracks. When water or other liquid is placed in the tank, the hydraulic pressure forces the wooden boards outwardly and the steel circumferential bands must be tightened again until the bands cut deep enough into the edges of the wood boards to counteract the outward force of the water or other liquid. While it is possible to shape the outer surface of the boards with the arc of the finished cylindrical tank, this is expensive and seldom done. Instead, commercially available flat boards are used.

There has been a great need for a waterproof tank that can be quickly assembled and which is free from leakage.

SUMMARY OF THE INVENTION

We have devised a tongue-and-groove board, preferably formed of plastic or other crush-resistant material, that can be quickly assembled with other such boards to form a waterproof tank. Furthermore, as the outside horizontal bands are tightened to pull our boards together, crushing is avoided and the boards are bent to define an arc in a horizontal plane, this arc of the tank being constructed regardless of the diameter of the tank within wide limits.

We achieve this result by having a section in my load that has a thin web joining a thick tongue section on one edge and a correspondingly thick groove section on the other edge. Further, we displace this web to one side so that the web section and the tongue-and-groove section define a continuous smooth outside surface which is normally flat, but which is a smooth arc when the segments are assembled into a tank.

DETAILED DESCRIPTION

Various objects, advantages, and features of the invention will be apparent in the following description and claims considered together with the accompanying drawings forming an integral part of this specification and in which:

Figure 1:
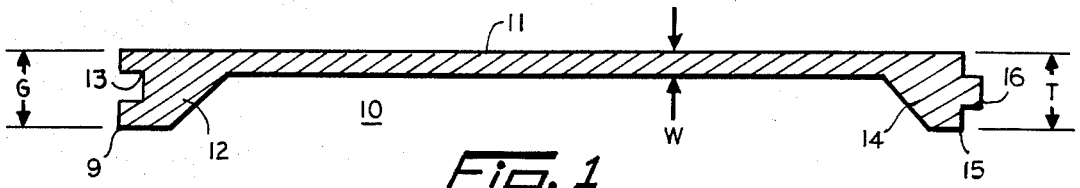
FIG. 1 is a cross sectional view through a presently preferred form of tank segment.

Referring to FIG. 1, a tank segment 10 has a thin web 11 having a thickness W joined at one edge to a thick groove section 12 having a longitudinally extending groove 13 and a thickness dimension G that is much greater than the web thickness W. The groove section 12 has an inner corner 9 that is preferably quite square. The other edge of the web 11 is joined to a tongue section 14 having an outwardly projecting tongue 16 and having a thickness dimension T. The tongue section thickness T is preferably the same as the groove section thickness dimension G of the groove section 12. The tongue section 14 has an inner corner 15 that is also preferably square.

Figure 2:
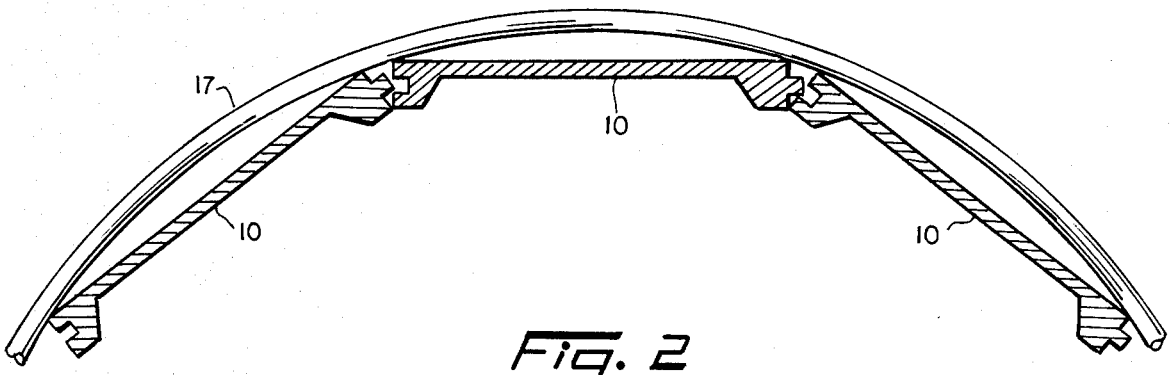
FIG. 2 is a plan view of several tank segments of FIG. 1 surrounded by a horizontal tension band prior to tightening.
Figure 3:
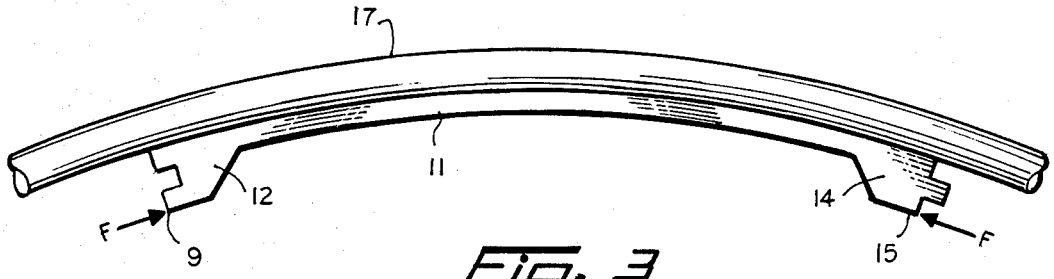
FIG. 3 is a plan view of the segment of FIG. 1 after it has been deflected to rest against the outer tensioning band.

Referring to FIG. 2, there is shown in exaggerated scale several tank segments in their normal flat condition butted together and loosely surrounded by a tension band 17. Normally, the tank segments are vertical and the band 17 is in a horizontal plane. As the band 17 is tightened, the tank segments 10 are bowed as shown in FIG. 3. This bowing is caused by a force F being applied at the inner corner 9 of the groove section 12 and the inner corner 15 of the tongue section 14 by the adjoining corner 15 and 9, respectively, of the adjoining groove and tongue sections.

Referring to FIG. 3, the band 17 has been tightened and the bowing just described causes the web 11 to rest against the curved band 17. When the tank is filled with a liquid placing a hydrostatic load on the vertical tank segments 10, there will be no deflection of the web 11, because it is already at its maximum deflection. There will be no tendency for the tongue and groove joints to separate under hydrostatic load, because the bands 17 are tightened sufficiently to accommodate this load without elastic stretching. Such tensioning does exert a compressive load in the general direction of the arrows F, and ordinarily such a compressive load would crumple the thin web 11. However, in its bowed condition of FIG. 3, the web 11 and the entire cross section are extremely stable due to the support of the band 17. In such a condition, even very thin webs 11 can sustain tremendous compressive loads.

Figure 4:
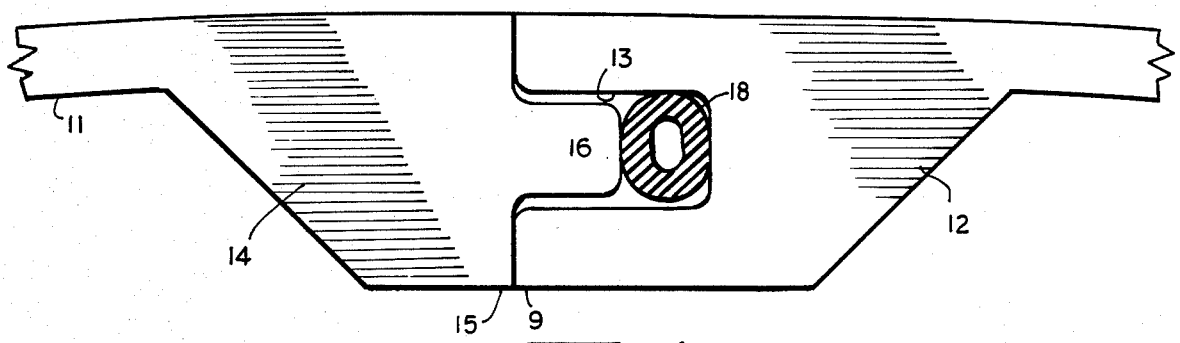
FIG. 4 is an enlarged plan view showing the joint between the groove of one tank segment and the tongue of the other tank segment.

Referring now to FIG. 4, a presently preferred seal is illustrated between a groove section 12 and a tongue section 14. The tongue 16 has less length than the depth of the groove 13, allowing room for a tubular seal 18 of rubber-like material which has a friction engagement with the inner end of the tongue 16 and the bottom of the groove 13. As liquid enters the crack between the corners 9 and 15, it forces the seal upwardly as viewed in FIG. 4 (outwardly of a tank formed of the segments 10) until it deforms in the upper part of the space to form a tight seal in the same fashion as the well-known "O-rings" in hydraulic components. The seal 18 may be solid, depending upon its composition, to achieve sealing.

EXAMPLE

While various materials of construction may be employed, the following example utilizing a plastic explains the action of any material. A polyester plastic reinforced with lengthwise strands of fiberglass has a transverse bending strength of 79,600 psi, a transverse compressive strength of 78,870 psi, and a transverse bending modulus of $1.71\times10^6$ psi. This material is preferably a pultrusion wherein fibers are pulled out the extrusion orifice along with the plastic, insuring linearity of the fibers.

Figure 5:
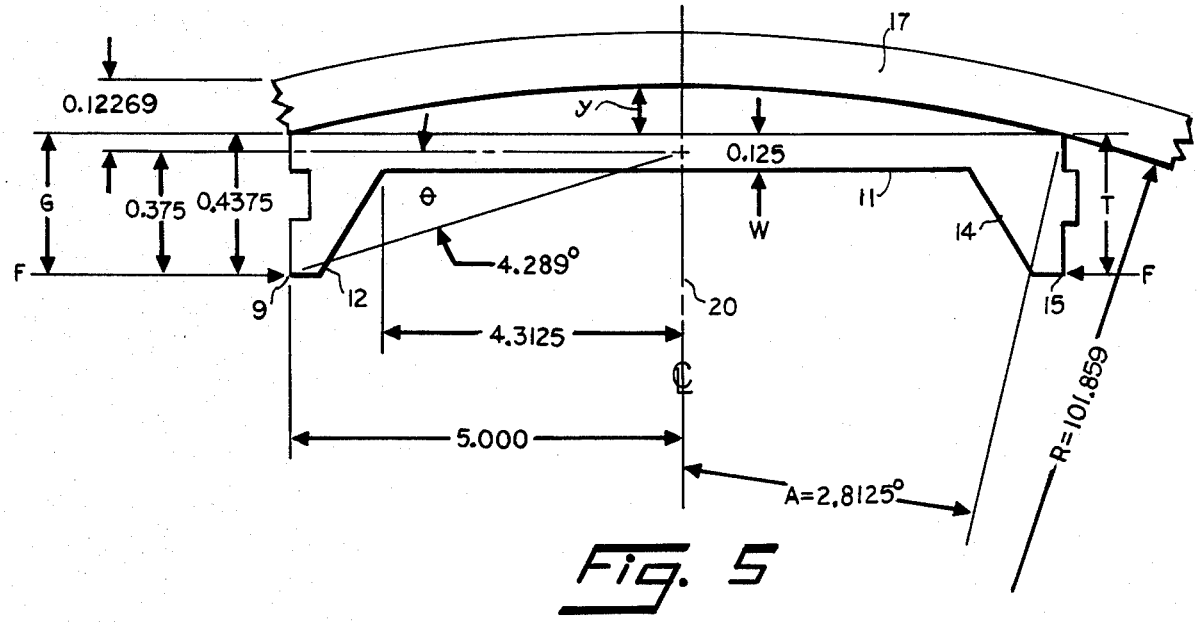
FIG. 5 is a dimensioned diagram of one example of my tank segments.

Referring to FIG. 5, it is assumed that tank segments have a width of ten inches; thus, sixty-four such vertical segments form a tank having a radius of 101.859 inches. If such a tank is 7½ feet high, it will hold about ten thousand gallons. The dimensions of the web 11 and the groove section 12 and the tongue section 14 are all stated in FIG. 5. A radius centerline 20 is used as a calculation reference; the amount that the flat web 11 must deflect to engage the band 17 is a dimension y which is calculated to be 0.12274 inch. This radius line 20 forms an angle A with the half width of segment 10. Another important angle is the one formed from the groove corner 9 to the center of the web 11 at the line 20, and this angle is designated as $\theta$.

The section modulus Z is 0.002604, and the moment of inertia I is 0.00016275 per vertical inch of segment 10. Taking the case of a beam supported at both ends and having a load at the center and knowing y, the amount the beam has to deflect to reach the band 17, this force is calculated at 2.55544 pounds per vertical inch of segment 10. The circumferential force F required to provide this deflection load is $$F=2.55544\times 1/\text{Tan}\ \theta=34.0726 \text{ pounds}$$

per vertical inch of segments 10. This force F is easily achieved by tensioning the horizontal bands 17.

For a 10,000-gallon tank, the bottom band 17 will receive the greatest stress and is tensioned to a load of 1800 pounds (of which 720 is required to counteract the hydrostatic load). The question arises whether the material of the segment 10 is strong enough to resist this overload stress prior to filling the tank. Referring still to FIG. 5, the cross sectional area of the two abutting tongue-and-groove sections is 0.255 square inches per vertical or linear inch of segment 10, and the load of 1800 pounds results in a pressure of 7,060 pounds per square inch, which is grossly less than the compressive strength of the material of 78,870 psi. Considering now the compression forces in the web which is 0.125 inch thick, the compressive force there is 14,400 psi, also considerably under the compressive strength of 78,870 psi. Usually, the web has a smaller compression area and is the limiting factor in compression.

The bending of the segments between horizontal bands due to hydrostatic loads produces a tendency of the tank segments 10 to bulge outwardly, the amount of bulging depending upon the resistance to bending in a vertical plane. This factor is well-known in tank design, and the high tensile strength of pultrusion fiberglass plastics causes them to compare favorably with steel. The size, number, spacing, and tension of the horizontal bands is well-known.

It will be appreciated by those skilled in the art that my normally flat tank segments 10 will automatically arc to the outer curvature of the tank by the mere tightening of the horizontal bands 17. This occurs regardless of the diameter of the tank so long as the elastic limit of the segment material is not exceeded. A universal segment is therefore created, resulting in great versatility and requiring only a small inventory of segments for a large number of tank sizes.

Further, this automatic arcing of the segments brings the entire exterior of the segments into contact with the horizontal bands, avoiding any cutting into the segment of the bands as is commonly the case when flat boards are used for the construction of tanks.

From the foregoing example, it is apparent that the tongue-and-groove thicknesses T and G need to be greater than the web thickness W only by an amount sufficient so that a bending moment arm is created to cause the bending of the segment 10 into contact with the band 17 as shown in FIG. 3.

This relative thickness is directly proportional to the width of the web 10 as shown by the angle $\theta$ of FIG. 5. It is directly proportional also to the stiffness of the web or its resistance to bending, which therefore is directly proportional to the Young's modulus for the particular material.

Further, it is apparent that the outer surface of the web 11 ought to be coincident with the outer surface of the groove section 12 and the tongue section 14 in order to obtain the greatest uniformity in bearing upon the bands 17. Also, the abutting surfaces of the tongues and grooves should be at right angles to this outer surface. Tongue-and-groove structures are not necessary, but are highly convenient in arranging the segments 10 as in FIG. 2 prior to tightening the bands 17. Also, the tongue-and-groove structure is easier to seal than many others.

Figure 6:
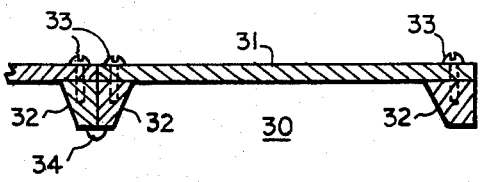
FIG. 6 is a sectional view of a modified form of segments without a tongue and groove.
Figure 7:
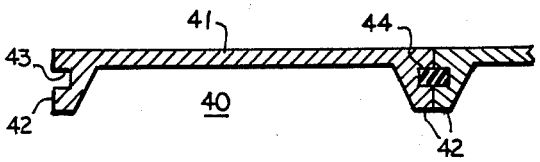
FIG. 7 is a sectional view through still another modified form of tank segment showing grooved edges on both edges.

Illustrated in FIG. 6 is a tank segment 30 having a web 31 and thicker edge sections 32 held by fasteners 33; the joint between the edges is sealed by a blob of caulking 34. Illustrated in FIG. 7 is a tank segment 40 having a web 41 and thicker edge sections 42, each of which has a groove 43, and sealing and alignment are obtained by inserting a rubber rod 44 between adjoining segments.

In addition to tanks my self-arcing segments may be used as horizontal flumes either semicylindrical for liquids like water or closed horizontal pipes for gases or liquids. The bands of semicylindrical flumes may be tightened against opposite ends of diameter beams. In either case, it is only necessary to stagger the joints in lengths of segments and seal the abutting ends in any suitable manner. Similarly, the segments may be used for smoke stacks, the material of construction being selected for the particular temperature and corrosion characteristics of the gases being conducted. Various other uses will occur to those skilled in the art. With regard to the pultrusion plastic, I presently prefer to use, in addition to the lengthwise fibers, short lengths of fiber that are randomly oriented, generally referred to as "matt" in the industry.

This invention has been described with reference to presently preferred embodiments as required by the statutes, but is not limited thereto, as this disclosure is illustrative only. The invention is not limited to this disclosure, and the following claims encompass all variations and modifications that fall within the true spirit and scope of the invention.

I claim:

1. An automatically arcing tank segment comprising:

(a) an elongated substantially flat web having a thickness, edges, and inner and outer surfaces;

(b) a tongue section connected to one edge of the web having a thickness greater than the web thickness and having an inner surface and an outer surface and an outer edge that is approximately at a right angle to the outer surface of the web and forming a square inner corner with said inner surface and forming a square outer corner with said outer surface and having a tongue projecting from the outer edge intermediate the inner and outer surfaces;

(c) a groove section connected to the other edge of the web and having a thickness greater than the web thickness and having an inner surface and an outer surface and an outer edge that is approximately at a right angle to the outer surface of the web and forming a square inner corner with said inner surface and forming a square outer corner with said outer surface and having a groove projecting inwardly intermediate the outer surface and the inner surface;

(d) characterized by the web being located at one side of the tongue-and-groove section and the outer surfaces of the web, tongue, and groove sections forming a continuous smooth outer surface, and also characterized by said tongue having a cross section wherein the outer end of the tongue is not greater in thickness than the base of the tongue, and also characterized by the groove cross section being of a substantially uniform width over the distance of the tongue projection, whereby the inner corner of the tongue section of one segment contacts the inner corner of the groove section of another segment to arc the cross sections of the segments.

2. An automatically arcing tank segment as set forth in claim 1 wherein the continuous smooth surface is flat.

3. An arcing tank segment as set forth in claim 1 wherein the thicknesses of the tongue section and the groove section are substantially the same.

* * * * *